US007938389B2

(12) United States Patent
Müller

(10) Patent No.: US 7,938,389 B2
(45) Date of Patent: May 10, 2011

(54) METHOD AND INSTALLATION FOR PROCESSING PRINTED PRODUCTS DURING CONVEYANCE

(75) Inventor: Erwin Müller, Dürnlen (CH)

(73) Assignee: Ferag AG, Hinwil (CH)

( * ) Notice: Subject to any disclaimer, the term of this patent is extended or adjusted under 35 U.S.C. 154(b) by 1141 days.

(21) Appl. No.: 11/652,350

(22) Filed: Jan. 11, 2007

(65) Prior Publication Data

US 2007/0170633 A1 Jul. 26, 2007

(30) Foreign Application Priority Data

Jan. 13, 2006 (CH) ..... 0055/06

(51) Int. Cl.
*B65H 37/04* (2006.01)

(52) U.S. Cl. ..... 270/52.26; 270/52.18; 270/52.3

(58) Field of Classification Search ..... 270/52.16, 270/52.18, 52.26, 52.29, 52.3
See application file for complete search history.

(56) References Cited

U.S. PATENT DOCUMENTS

| | | | | |
|---|---|---|---|---|
| 4,641,825 | A * | 2/1987 | Mowry et al. | 270/52.26 |
| 5,810,345 | A * | 9/1998 | Lehmann et al. | 270/52.26 |
| 6,223,964 | B1 * | 5/2001 | Muller | 227/81 |
| 6,655,674 | B2 * | 12/2003 | Muller | 270/52.18 |
| 2002/0140155 | A1 * | 10/2002 | Muller | 270/58.08 |
| 2004/0089991 | A1 * | 5/2004 | Stauber | 270/52.3 |
| 2005/0236757 | A1 * | 10/2005 | Mockli | 270/52.14 |
| 2009/0160116 | A1 * | 6/2009 | Ramseier | 270/58.11 |

FOREIGN PATENT DOCUMENTS

| | | |
|---|---|---|
| EP | 0 399 317 A1 | 11/1990 |
| EP | 0 546 326 | 6/1993 |
| EP | 0 606 555 | 7/1994 |
| EP | 1 245 406 | 10/2002 |
| EP | 1 588 971 A1 | 10/2005 |

* cited by examiner

*Primary Examiner* — Leslie A Nicholson, III
(74) *Attorney, Agent, or Firm* — Holtz, Holtz, Goodman & Chick PC

(57) ABSTRACT

Printed products produced by assembling on saddle-shaped supports are conveyed onwards lying on the supports and during this conveyance are processed in the area of their fold line between a tool acting from outside and a counter-tool acting from inside, i.e., from the supported side. For being processed, the printed products are lifted off from the saddle line of the supports by the counter-tools, such that a relative movement between the saddle-shaped support and the counter-tool does not deform or damage the printed products. Through this measure it becomes possible to design the circuit of the supports and the circuit of the counter-tools largely independent of one another. The supports or their saddle lines respectively, for example, are able to move through the processing zone in a straight line, while the distal ends of the counter tools circulate on a round circuit.

12 Claims, 4 Drawing Sheets

METHOD AND INSTALLATION FOR PROCESSING PRINTED PRODUCTS DURING CONVEYANCE

FIELD OF THE INVENTION

The invention is related to a method and an installation for processing printed products, which are conveyed essentially continuously lying on saddle-shaped supports arranged in essence transverse to the conveying direction.

BACKGROUND OF THE INVENTION

It is known to produce printed products by assembling folded sheets or folded partial products, wherein at successive feeding points these are placed on to saddle-shaped supports being conveyed continuously and usually aligned transverse to the conveying direction, such, that the inner fold line of the first folded sheet or partial product is lying on the saddle line of the support and the two folded parts are supported by the support or hang substantially freely downwards, and such, that further supplied sheets or partial products are placed on to the first sheet and on top of one another. For folding sheets or partial products in the named manner, for example, a rotating collecting drum is utilised, in which a plurality of saddle-shaped supports are arranged in star-form. The saddle lines of the saddle-shaped supports extend in axial direction on the circumference of the drum. The axial length of the saddle-shaped supports and of the saddle lines usually is longer by a multiple than the length of the fold lines of the printed products to be produced and these are displaced on the supports in such a manner, that every printed product under production is moved around the axis of the drum several times in a spiral-shaped track and in each one of these rotations, usually in the area of the upper zenith of the drum, passes a feeding point, where another sheet or partial product is placed on to the sheets or partial products already lying on the saddle-shaped support.

Also known are linear assembling installations, in which the saddle-shaped supports, which again are arranged essentially transverse to the conveying direction, are conveyed in a more or less straight line past feeding points arranged one after the other in such a manner, that the products being produced do not have to be displaced along the saddle lines.

It is also known to process printed products produced by assembling during their further conveyance on the saddle-shaped supports (in the collecting drum or in a linear system). For such processing they are treated in the area of their fold line lying on the saddle line, namely between a tool and a counter-tool, wherein the tools act on the fold area of the printed product, the tool from outside and the counter-tool from inside, i.e. from the side of the saddle-shaped support. It is in particular known to staple folded printed products during their conveyance between a stapling head (tool) and a folder (counter-tool) or to clamp the printed products for measuring their thickness between an external probe (tool) and an internal probe (counter-tool).

When, for the mentioned type of processing, the conveying speed of the saddle-shaped supports is relatively high and the processing is to be carried out reliably and without any impairment of the printed products, it is according to the current opinion necessary, that the distal ends of tool and counter-tool, between which the processing is carried out, are arranged at the same level as the saddle line and that tool, counter-tool, and saddle-shaped support are conveyed such that their positions relative to each other remain unchanged for at least a short time. Only in this manner there are no relative movements between tool and counter-tool and between tools and saddle-shaped support during the processing, which relative movements may undesirably deform or damage the products lying on the saddle-shaped supports. In accordance with prior art, this is achieved with various measures.

For example, every saddle-shaped support is equipped with a tool and a counter-tool and conveyed together with these, wherein, when conveyed through a predefined part of the conveying track, the tool and/or the counter-tool are brought into a processing position relative to one another (distal tool ends in the area of the saddle line of the saddle-shaped support) and are activated. For the processing, i.e. during conveyance through a processing zone, tool and counter tool are held in the named processing position. By equipping the saddle-shaped supports in the named manner, it is easily possible to maintain tool, counter-tool and saddle-shaped support stationary relative to one another (in processing position) even during a lengthier processing period. On the other hand, however, it is very expensive to equip all saddle-shaped supports correspondingly, this in particular in the case of systems, in which the printed products are conveyed over relatively long stretches on saddle-shaped supports arranged tightly behind one another and are to be processed in various manners. If the tools or the saddle-shaped supports equipped with the tools respectively also have to be correspondingly adjusted for enabling processing of different printed products, production changes are associated with a lot of work and as a result of this with lengthy production losses, which may well represent a further disadvantage.

It is also known to arrange the tools in smaller numbers along shorter circuits and to a limited extent independent from the circuit of the saddle-shaped supports and to connect the counter-tools either with the saddle-shaped supports (e.g., described in EP-0546326 or EP-0606555) or with the tools (e.g., described in EP-1245406. The circuit of the tools and the circuit of the saddle-shaped supports are adapted to one another in the processing zone in such a manner, that there are undesirable relative movements neither between tools and counter-tools nor between tools and saddle-shaped supports. This means that the circuits of the tools, of the counter-tools and of the saddle-shaped supports have at least through the processing zone a constant distance from each other and the same directions, wherein tools, counter-tools and saddle-shaped supports are aligned to one another during the conveyance through the processing zone, i.e. they are conveyed in synchronism. It is particularly advantageous, because easily implemented with respect to the installation, to realize the circuit of the tools to be a round circle and to arrange as few tools as possible (if so required with counter-tools) along this circuit, i.e. keep the radius of the circular circuit as small as possible. The circuit of the saddle-shaped supports (if so required with counter-tools) is then at least in the processing zone to have the form of a circular arc having the same centre as the circuit of the tools and also a relatively small radius. This, however, leads to constraints regarding space, which may be serious and undesirable in particular for cases, in which different processing operations are to be carried out in successive processing zones.

BRIEF DESCRIPTION OF THE INVENTION

It is the objective of the invention to create a method and an installation for processing printed products between a tool and a counter-tool during their conveyance on saddle-shaped supports, wherein, with the installation according to the invention it shall be possible to avoid the above mentioned disadvantages of known methods and installations serving the same purpose. The installation according to the invention shall therefore in particular make it possible, that the circuit of the saddle-shaped supports shall remain freely selectable, also in the processing zones, and to the greatest possible extent independent of the processing, that nonetheless the saddle-shaped supports do not have to be equipped either with tools or with counter-tools and that despite this it is possible to ensure in a simple manner, that the printed products to be processed are neither deformed nor damaged by undesirable relative movements.

The method and the installation according to the invention are based on the idea of lifting the printed products, for being processed, off the saddle line of the saddle-shaped supports using the counter-tools. This means, that according to the invention the task of carrying and guiding the printed products in the processing zone is at least partially taken over by the counter-tools, whereas, during conveyance without processing (and also during processing according to known methods), this task is attended to solely by the saddle-shaped supports. In the installation according to the invention, the printed products are conveyed into the processing zone on the saddle-shaped supports in the same way as in known installations, which serve the same purpose, and they are conveyed away from the processing zone again in the same manner. In the processing zone itself, however, they are lifted up by the counter-tools, the distal ends of which are moved from below through corresponding openings or recesses in the saddle-shaped supports. Therewith, the printed products are lifted off the saddle line in such a manner, that their internal fold lines are not anymore supported on the saddle lines of the saddle-shaped supports, while the product parts on both sides of the fold line are advantageously still supported on the sides of the saddle-shaped supports.

The distal ends of the counter-tools moving through the saddle-shaped supports take over the carrying and guiding of the printed products to be processed to such an extent, that a relative movement between the saddle-shaped support and the counter-tool allocated to it can act on the printed product neither by deforming nor by damaging it. Because in this way, the relative movements between the saddle-shaped supports and the printed products to be processed become harmless and therefore can be tolerated, it becomes possible to design the circuit of the saddle-shaped supports and the circuit of the counter-tools such that also in the processing zone they have not the same directions and changing distances between one another, which results in significantly more independence of the two circuits from one another.

The circuit of the counter-tools has advantageously the form of a round circle of a relatively small radius and with a centre located underneath the track of the saddle-shaped supports. It is possible to superimpose on the primary circular movement of the counter-tools a secondary movement for bringing the counter-tools into a processing position for the processing. The circuit of the saddle-shaped supports, for example, extends trough the processing zone in a straight line or curved around a large radius, wherein the track of the saddle lines and the track of the distal ends of the counter-tools intersect, so that, within the processing zone, the latter extends above the former, prior to and following the processing zone, however, below it. Apart from this intersecting with one another, the tracks of the counter-tools and the saddle-shaped supports are independent form one another. The saddle-shaped supports, as already mentioned further above, are provided with openings or recesses in the area of the saddle line, wherein these openings or recesses have to be sufficiently large to permit not only the passing through of the distal ends of the counter-tools (relative movement between the counter-tool and the saddle-shaped support transverse to the direction of conveyance), but if so required also a relative movement between the counter-tool and the saddle-shaped support parallel to the direction of conveyance.

Cooperation between tools and counter-tools is advantageously substantially the same in the method and installation according to the invention as in known such methods and installations. The tools, for example, also circulate on round circuit, wherein the centre of this circuit is above the track of the saddle-shaped supports and wherein the number of circulating tools can be the same as the number of the circulating counter-tools or different from it. A secondary movement is to be superimposed on the primary movement of the tools around the circle in such a manner, that, during conveyance through the processing zone, the tools remain aligned to the counter-tools in a predefined manner. Tools of this kind are described, for example, in the publication EP-0606555.

The method and the installation according to the invention are suitable in particular for stapling printed products produced by assembling folded printed sheets or for measuring the thickness of such printed products. It is also conceivable for such printed products to be pressed and impinged with ultrasound or heat for activation of an adhesive applied in the folds of the stacked sheets forming the printed product.

BRIEF DESCRIPTION IF THE DRAWINGS

The principle of the method and of the installation according to the invention and examples of embodiments of the installation are described in more detail in association with the following Figs., wherein.

DETAILED DESCRIPTION OF THE INVENTION

Figure 1:
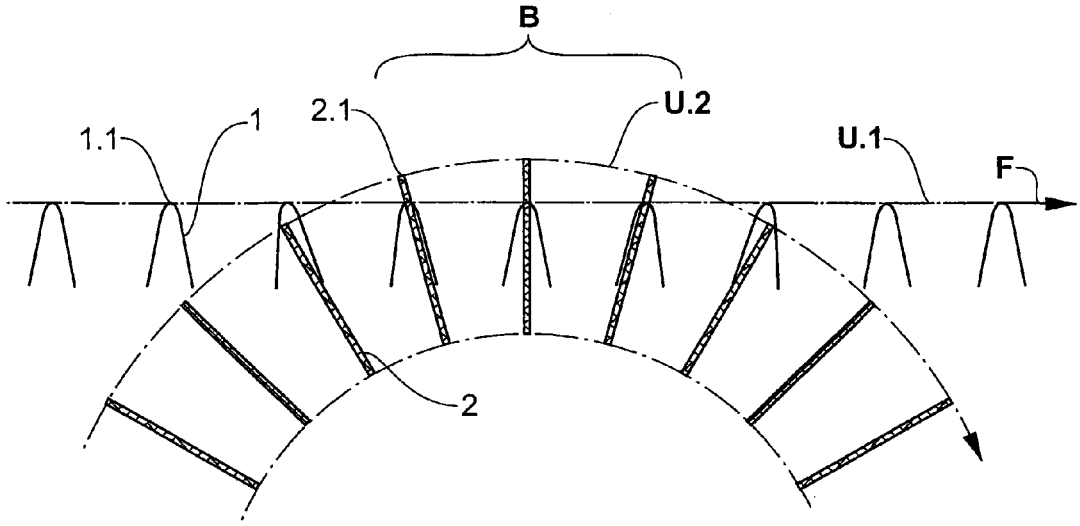
FIGS. 1 and 2 show the principle of a first, preferred embodiment of method and installation according to the invention, wherein only a central part of the installation is shown viewed from the side (FIG. 1) and viewed from above (FIG. 2)
Figure 2:
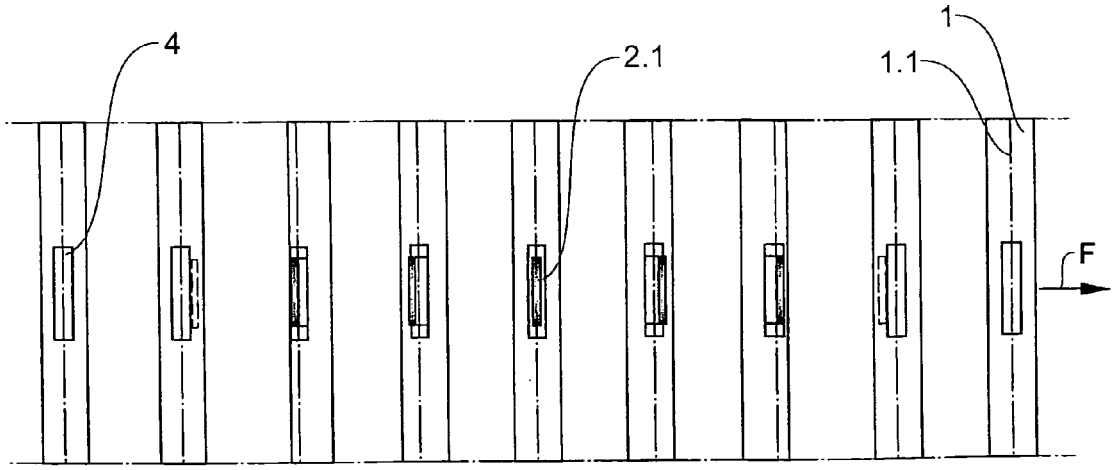

FIGS. 1 and 2 illustrate the principle of a first, preferred embodiment of method and installation according to the invention, wherein only a part of the saddle-shaped supports 1 and of the counter-tools 2 as well as partial zones of the circuit U.1 of the saddle lines 1.1 of the saddle-shaped supports 1 and of the circuit U.2 of the distal ends 2.1 of the counter-tools are depicted. FIG. 1 illustrates the installation viewed from the side, i.e. with a direction of view essentially parallel to the saddle lines 1.1 of the saddle-shaped supports 1, FIG. 2 viewed from above, i.e. with a direction of view on to the saddle lines of the saddle-shaped supports 1.

The circuits U.1 and U.2 intersect at the entrance to the processing zone B and at the exit of the processing zone B, wherein the circuit U.2 extends above the track U.1 in the processing zone B. This means, that the distal ends 2.1 of the counter-tools 2 are positioned above the saddle lines 1.1 of the saddle-shaped supports 1 during conveyance through the processing zone B and conveyed printed products (not depicted) or their internal fold lines respectively are therefore lying on the distal ends 2.1 of the counter-tools 2 and not on the saddle line 1.1 of the saddle-shaped supports 1. For this purpose, the distal ends of the counter-tools move through openings 4 in the saddle-shaped supports, which openings are arranged in the area of the saddle line.

The saddle-shaped supports 1, for example, are arranged on a conveyor chain (not depicted) with a regular spacing and comprise on both sides of the saddle line 1.1 side pieces sloping downwards. In the embodiment illustrated in FIGS. 1 and 2 the supports are freely swivellable relative to the conveyor chain around a rotation axis extending in the range of the saddle line 1.1 and parallel to it or else coinciding with the saddle line. The supports are swivelled by the counter-tools 2. In this manner, it becomes possible to introduce the counter-tools 2 into the supports essentially from below, without the,distal ends 2.1 of the counter-tools having to deviate from their round circuit (no secondary movement superimposed on the primary movement around the circle).

FIG. 1 shows the relative movement between the counter-tools 2 and the saddle-shaped supports 1 perpendicular to the conveying direction F, FIG. 2 the relative movement parallel to the conveying direction F.

Figure 3:
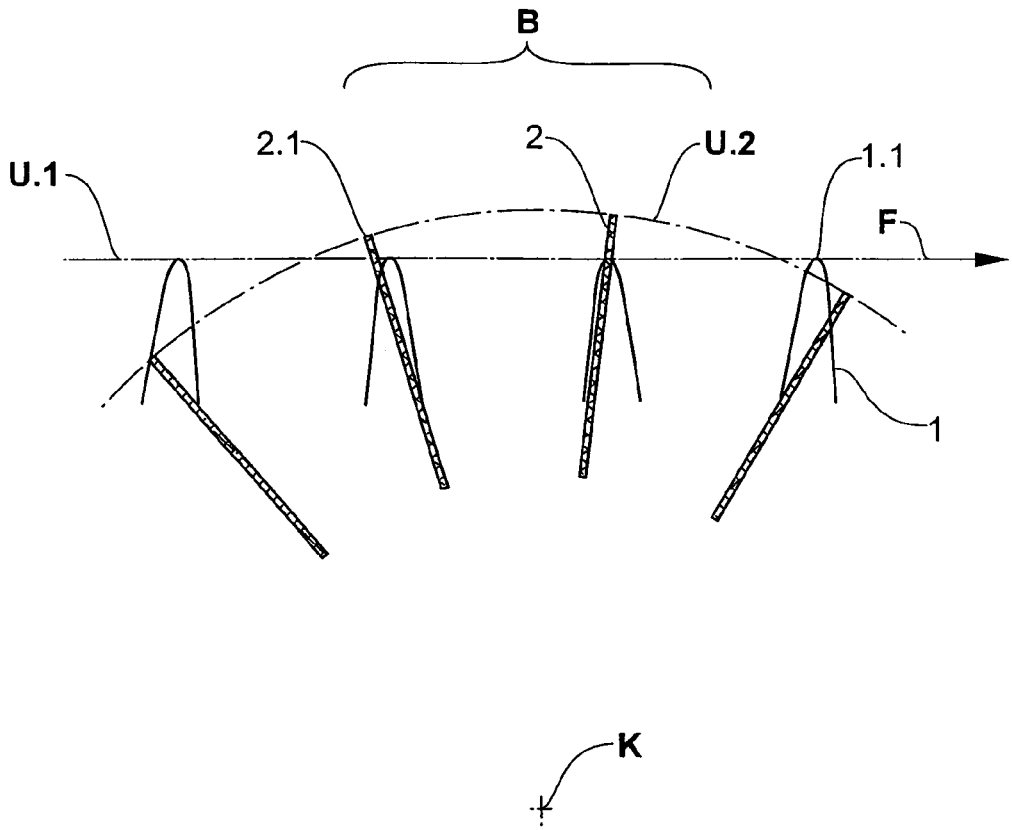
FIGS. 3 and 4 show the principle of a second, preferred embodiment of method and installation according to the invention, wherein only a central part of the installation is shown viewed from the side (FIG. 3) and from above (FIG. 4)
Figure 4:
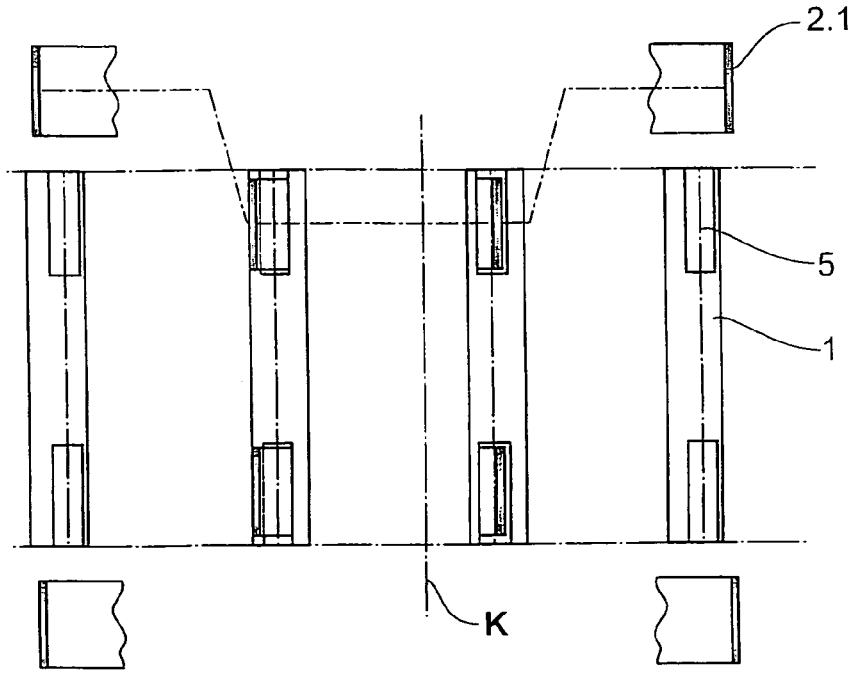

FIGS. 3 and 4 illustrate a second, preferred embodiment of method and installation according to the invention. The manner of depiction is the same as in the FIGS. 1 and 2 and the same elements are designated with the same reference numerals. The supports 1 of the embodiment according to FIGS. 3 and 4 have an orientation relative to the circuit U.1 which remains unchanged, i.e. they are not swivellable. For this reason, the distal ends 2.1 of the counter-tools 2, which again move on a round circuit, can only be introduced into the supports 1 from below, if a secondary movement is superimposed on their primary movement along the circle. This secondary movement is directed parallel to the axis K of the round circuit, wherein the distal ends 2.1 of the counter-tools 2 are moved into the range of the supports 1 at the entrance to the processing zone B and away from the supports 1 at the exit from the processing zone B, as is clearly evident from FIG. 4. Obviously, in this case it is advantageous to lift the distal ends 2.1 of the counter tools 2 over the saddle lines 1.1 of the saddle-shaped supports 1 through lateral recesses 5. It is, however, also possible to design the saddle-shaped supports 1 as correspondingly narrower than the printed products to be processed and to run-up the distal ends of the counter-tools on either side of the supports, which renders the secondary movement superfluous.

In further embodiments of method and installation according to the invention, the distal ends of the counter-tools are introduced into the supports 2 by means of other movements, for example, by a radial movement or by a radial elongation of the counter-tools and/or by a controlled changing of the position of the counter-tools relative to their circuit. Combinations of such methods and installations with methods and installations illustrated in the FIGS. 1 to 4 are conceivable.

Figure 5:
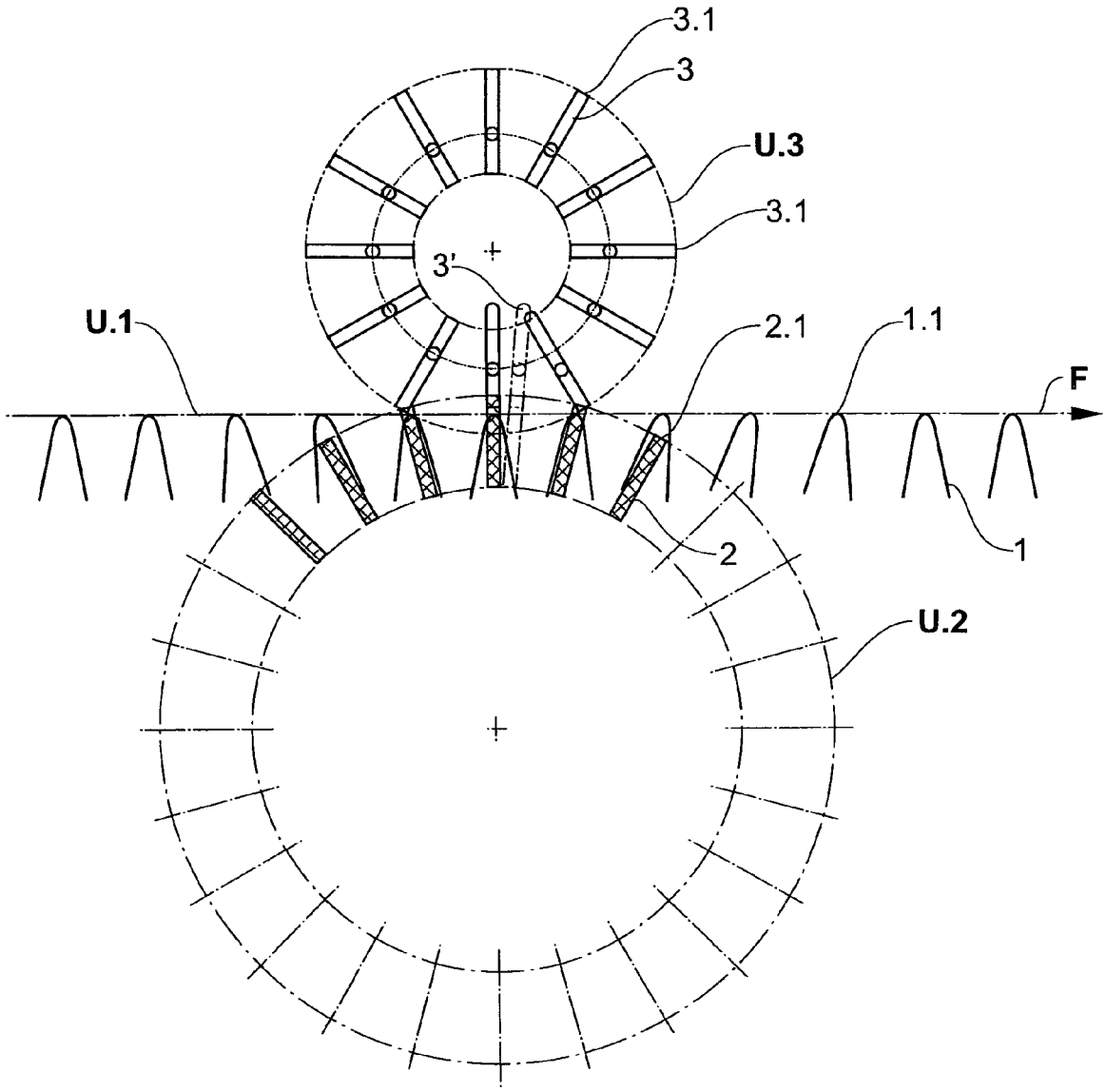
FIG. 5 shows an exemplary embodiment of the installation according to the invention in accordance with the principle as shown in FIGS. 1 and 2.

FIG. 5 illustrates an exemplary embodiment of the installation according to the invention, which works according to the principle represented in the FIGS. 1 and 2 (supports 1, which are swivelled by the counter-tools 2). The tools 3 depicted in FIG. 5 circulate along a round circuit, wherein, in the processing zone, the movement of the distal tool ends 3.1 is adapted to the movement of the counter-tools 2 by changing the tool position relative to their track (visible in particular on the tool designated with 3' in an intermediate position) and by a radial tool movement towards the inside of the circuit. The resulting circuit U.3 of the distal tool ends 3.1 is such, that during processing no relative movement between the distal ends of the two cooperating tools results. The change in the tool position is controlled, for example, by cams and the radial movement by the counter-tools 2, which press the tools 3 against the inside of circuit U.3 against the force of a biasing spring, with which it is also possible to produce a pressure force between the two tool ends, which may be necessary for the processing.

Figure 6:
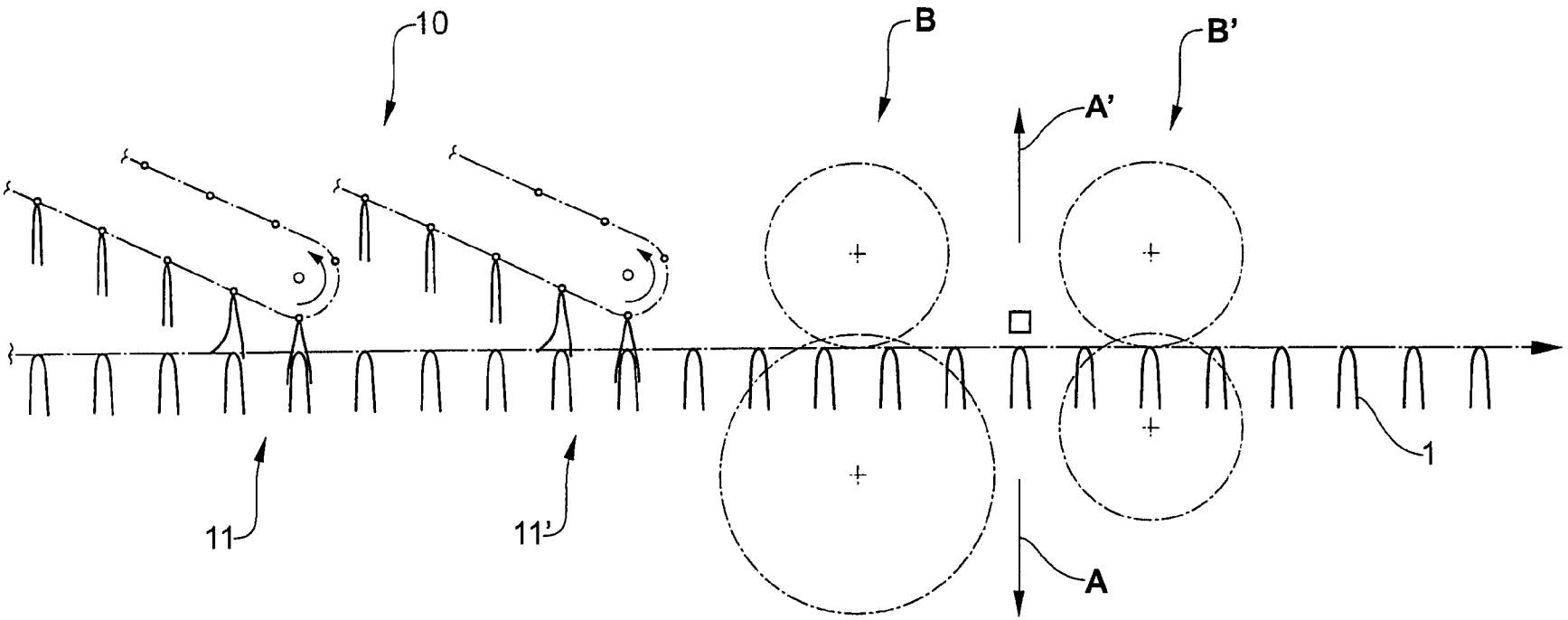
FIG. 6 shows an arrangement comprising an assembling course and two installations according to the invention arranged down-stream of the assembling course.

FIG. 6 very schematically illustrates a linear assembling installation 10, in which folded sheets or partial products are placed on saddle-shaped supports 1 at successive feed points 11 and 11', as a result of which printed products are produced, which, for example, consist of a plurality of sheets folded into one another. The supports 1, for example, are attached to a conveyor chain with a regular spacing. The assembled products are conveyed on through two successive processing zones B and B' by the same supports 1, wherein the processing zones are equipped according to the invention. The first processing operation (processing zone B), for example, is a thickness measurement, the second processing operation (processing zone B') a stapling operation. Between the two processing operations, for example, a discharge point is arranged, at which printed products not having the predefined thickness, i.e. comprising too few or too many sheets, are removed (arrows A and A').

According to the above description and the presented Figs. the saddle-shaped supports are conveyed with a regular spacing, i.e. they, for example, are arranged on a conveyor chain with a regular spacing. This, however, is not a condition for the method and the installation according to the invention. It is also possible, that the supports are flexibly connected with each other to form a chain in which they can assume differing distances from one another or they may be conveyed completely independent of one another, for example, guided in a rail. It goes without saying, however, that supports independent of one another have to be synchronised ahead of the processing zone with the counter-tools and tools which are circulating with a regular spacing. Upstream and/or downstream of the processing zone, however, it is possible, for example, to buffer them.

The invention claimed is:

1. A method for processing folded printed products, the method comprising the steps of:

conveying folded printed products on saddle-shaped supports comprising saddle lines aligned essentially transverse to the direction of a conveyance into a processing zone, through the processing zone and away from the processing zone, and simultaneously with the step of conveying the folded printed products through the processing zone, processing a fold line area of the printed products between a tool acting on the fold line area from outside and a counter-tool acting on the fold line area from inside, wherein, during the conveyance to and away from the processing zone, internal fold lines of the printed products are lying on the saddle lines, wherein, during the conveyance through the processing zone, the printed products are lifted-off the saddle lines by the counter-tools, wherein the counter-tools and the saddle-shaped supports are conveyed along two different circuits, wherein a first circuit of the saddle lines of the supports and a second circuit of the distal ends of the counter-tools intersect at an entrance and at an exit of the processing zone in such a manner, that in the processing zone, the second circuit is located above the first circuit, and wherein the distal ends of the counter-tools are moved through openings or recesses, which are arranged in the saddle-shaped supports in an area of the saddle lines.

2. The method according to claim 1, wherein at least in the processing zone, the second circuit is arc-shaped and the first circuit runs in a straight line.

3. The method according to claim 1, wherein the saddle-shaped supports are conveyed through the processing zone in an unchanged position relative to the first circuit.

4. The method according to claim 1, wherein the saddle-shaped supports are swivelled relative to the first circuit by the counter-tools.

5. The method according to claim 1, wherein the printed products comprise a plurality of folded sheets or partial products folded into one another and, prior to the processing, are produced by being assembled on the saddle-shaped supports.

6. An installation for the processing of folded printed products, the installation comprising:

a plurality of saddle-shaped supports comprising saddle lines essentially aligned transverse to the direction of conveyance, wherein the saddle-shaped supports are circulating with the saddle lines being conveyed along a first circuit, wherein in an area of the saddle lines, the saddle-shaped supports comprise recesses or openings, a plurality of tools and a plurality of counter-tools, the tools and the counter-tools being equipped for processing a fold line area of the printed products between the tool acting on the fold line area from outside and the counter-tool acting on the fold line area from inside, wherein the counter-tools are circulating with distal ends thereof being conveyed along a second circuit, and the distal ends of the counter-tools being operable to move through the recesses or the openings of the saddle-shaped supports, the counter-tools being operable to lift-off the printed products from the saddle lines, wherein the first circuit and the second circuit intersect at an entrance and at an exit of a processing zone, such that, in the processing zone, the second circuit is located above the first circuit, and upstream and downstream of the processing zone, and the second circuit is located beneath the first circuit.

7. The installation according to claim 6, wherein the saddle-shaped supports are conveyable through the processing zone in an unchangeable position relative to the first circuit.

8. The installation according to claim 6, wherein the saddle-shaped supports are swivellable around a swivelling axis, and wherein the swivelling axis extends in the area of the saddle lines and parallel to it or coincides with it.

9. The installation according to claim 6, wherein the second circuit is arc-shaped in the processing zone.

10. The installation according to claim 9, wherein the second circuit is round and a secondary movement transverse to the second circuit is superimposed on the conveyance of the distal ends of the counter-tools along the second circuit, by means of which the secondary movement of the distal ends are movable towards the saddle-shaped supports at an entrance to the processing zone and are movable away from the saddle-shaped supports at the exit from the processing zone.

11. The installation according to claim 6, wherein the first circuit runs in a straight line at least within the processing zone.

12. The installation according to claim 6, wherein the tools are arranged as circulating along a third circuit, which is round, wherein the tools have a changeable orientation relative to the third circuit and are arranged to be movable in a radial direction.

* * * * *